US006135424A

United States Patent [19]

Bracke

[11] Patent Number: 6,135,424

[45] Date of Patent: Oct. 24, 2000

[54] TENSIONED CABLE RAILING

[76] Inventor: Horst A. Bracke, 34 Hudson River La., Garrison, N.Y. 10524

[21] Appl. No.: 09/270,068

[22] Filed: Mar. 16, 1999

[51] Int. Cl.[7] ..... E04H 17/14

[52] U.S. Cl. ..... 256/59; 256/1; 256/37; 256/65

[58] Field of Search ..... 256/59, 65, 24, 256/34, 32, 13.1, 67, 37, 40, 43, 44, 46, 47, 48, 1, 21, 22

[56] References Cited

U.S. PATENT DOCUMENTS

| | | | |
|---|---|---|---|
| 319,057 | 6/1885 | Bickley | 256/48 X |
| 471,831 | 3/1892 | Speakman | 256/34 |
| 505,781 | 9/1893 | Vance | 256/65 |
| 517,921 | 4/1894 | Goehring | 256/21 |
| 607,410 | 7/1898 | Flanagan et al. | 256/37 |
| 2,337,626 | 12/1943 | Sawyer | 256/1 |
| 3,305,221 | 2/1967 | Kling | 256/21 |
| 3,770,245 | 11/1973 | Murdock | 256/24 |
| 4,146,212 | 3/1979 | Lermer | 256/65 |
| 4,690,384 | 9/1987 | Palmer | 256/47 |

*Primary Examiner*—Harry C. Kim
*Attorney, Agent, or Firm*—Brady, O'Boyle & Gates

[57] ABSTRACT

A tensioned cable railing wherein a cable extends in a serpentine manner between top and bottom horizontal extending rails connected at opposite ends to vertical posts. Tubular spindles extend between the top and bottom rails in proximity to the posts, and a tensioning mechanism is mounted in each tubular spindle and connected to a respective end of the cable for maintaining the proper tension on the cable. The bight portions of the serpentine cable are received in longitudinally extending grooves provided in the top and bottom rails to enhance the appearance of the railing.

7 Claims, 2 Drawing Sheets

TENSIONED CABLE RAILING

BACKGROUND OF THE INVENTION

Various railings or fences have been proposed wherein a wire extends in a serpentine manner between horizontally extending top and bottom rails. While these railings have been satisfactory for their intended purpose, they have been characterized by the disadvantage of the wire losing its tension and becoming loose rendering the railing unsafe; thus, requiring a restringing of the wire. Furthermore, when stringing the wire in a serpentine manner, the bight portions of the serpentine wire extend over the exterior surfaces of the top and bottom rails; thus, presenting an unfinished appearance to the railing.

SUMMARY OF THE INVENTION

After considerable research, and experimentation, the tensioned cable railing of the present invention has been devised and comprises, essentially, a pair of horizontally spaced vertically extending posts, and a pair of horizontally extending, vertically spaced rails connected at each end to a respective post, to thereby provide top and bottom rails for the railing. A plurality of horizontally spaced vertically extending tubular spindles are connected at each end to a respective top and bottom rail. A cable extends in a serpentine manner between the top and bottom rails and is anchored at each end to a tensioning mechanism mounted within a respective tubular spindle, whereby the tension of the cable between the top and bottom rails can be adjusted to maintain the serpentine cable taut at all times. A longitudinally extending groove is provided in the top and bottom rails which receive the bight portions of the serpentine cable.

Not only is the tensioned cable railing more pleasing in appearance than prior wire railings, but by its construction and arrangement, it is not likely to lose its tension over long periods of use; thereby, being safer than prior wire railings.

DESCRIPTION OF THE PREFERRED EMBODIMENT

Figure 1:
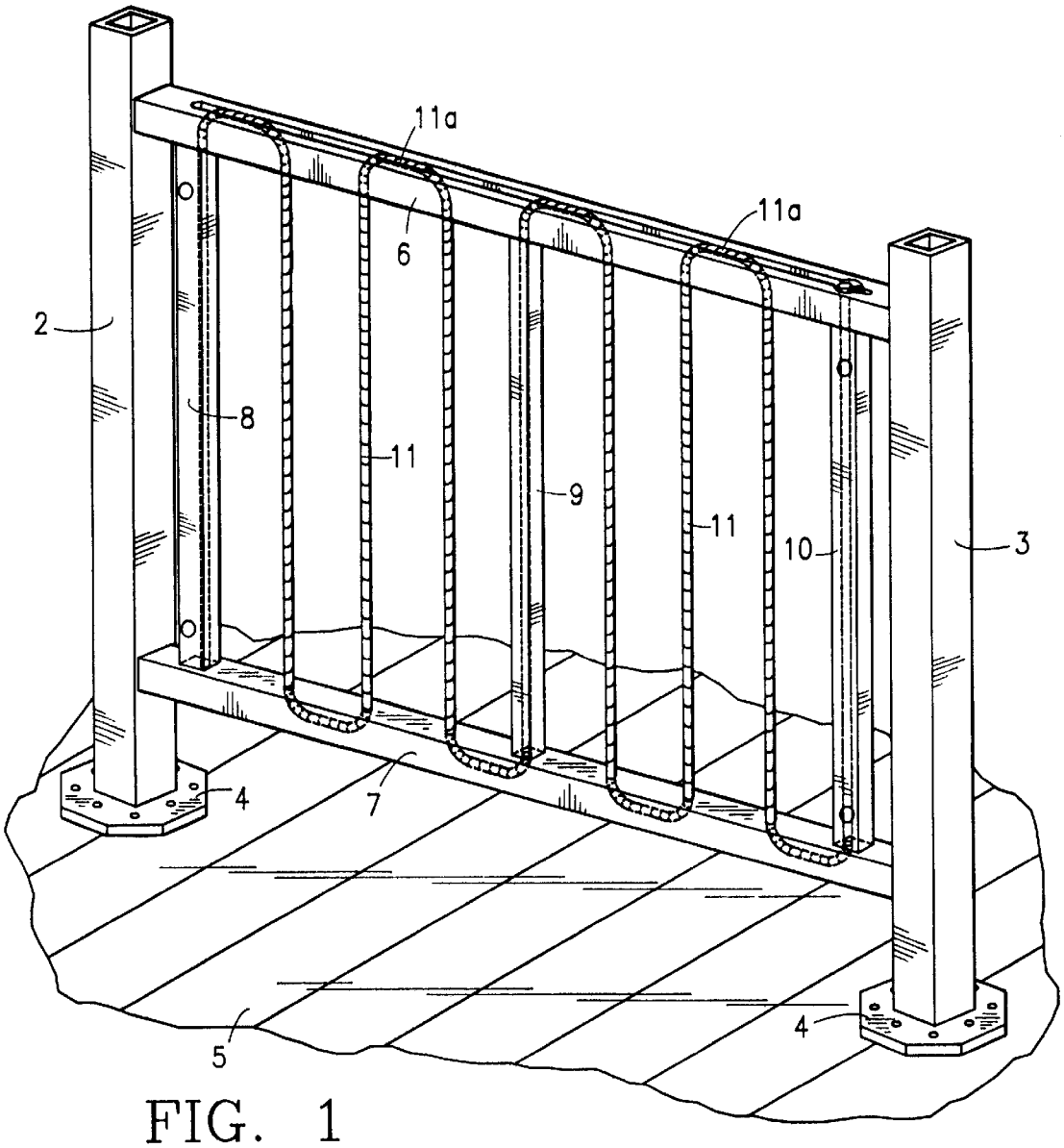
FIG. 1 is a perspective view of the tensioned cable railing of the present invention.
Figure 2:
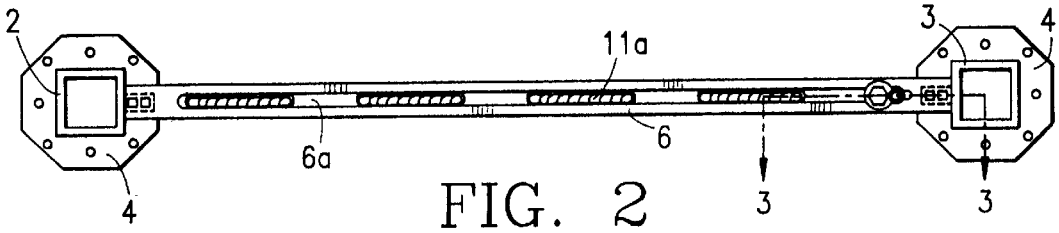
FIG. 2 is a top plan view of the railing shown in FIG. 1.

Referring to the drawings, and, more particularly, to FIGS. 1 and 2, the tensioned cable railing 1 of the present invention comprises a pair of horizontally spaced, vertically extending posts 2 and 3 having flanged base plates 4 at their lower ends for securing the railing 1 to a supporting surface 5, such as a porch, patio, or lanai. A pair of horizontally extending, vertically spaced rails 6 and 7 are connected at each end thereof to a respective post 2 and 3, to thereby provide top and bottom rails for the railing 1. A plurality of horizontally spaced, vertically extending tubular spindles 8, 9, and 10 extend between and are connected to the rails 6 and 7, and a tensioned cable 11 extends in a serpentine manner between the top and bottom rails 6 and 7, through the tabular spindle or rigid spacer tube 9 and connected at each end to a tensioning mechanism, to be described more fully hereinafter, contained in the tubular spindles 8 and 10.

Figure 3:
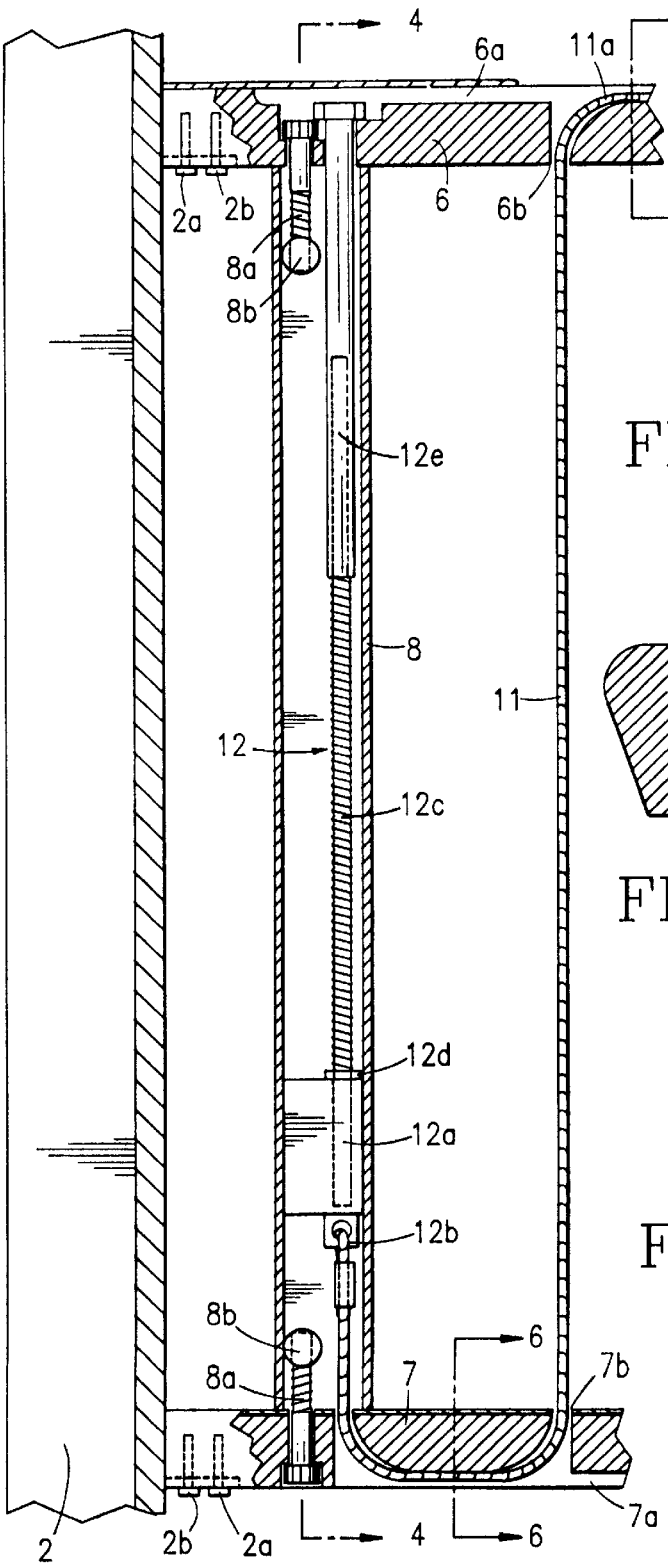
FIG. 3 is a sectional view taken along line 3—3 of FIG. 2.
Figure 4:
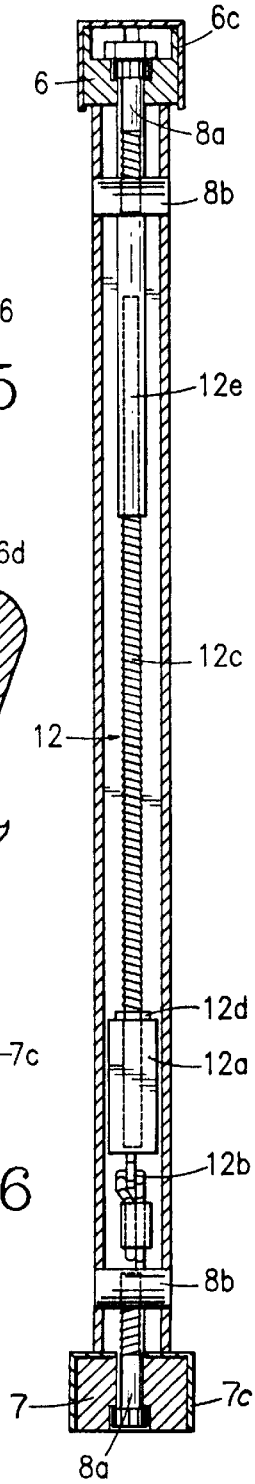
FIG. 4 is a sectional view taken along line 4—4 of FIG. 3.

The details of the construction of the railing 1 are illustrated in FIGS. 3 and 4 and, while the construction of the end portion of the railing 1 adjacent the post 2 is shown, it will be understood that the construction of the opposite end portion of the railing 1 adjacent post 3 is identical. The ends of the top rail 6 and bottom rail 7 are connected to the post 2 by plates 2*a* connected to the post 2 and bolts 2*b* extending through the plates 2*a* and extending into the rails 6 and 7. Each of the rails 6 and 7 is provided with a longitudinally extending groove 6*a*, 7*a*, and a plurality of longitudinally spaced, vertical openings 6*b* and 7*b* through which the cable 11 extends in its serpentine path.

The tubular spindle 8 is secured to the top and bottom rails 6 and 7 by a vertically extending bolt 8*a* extending through the rails 6 and 7 and threaded into a transversely extending solid cylinder 8*b* fixedly secured to the walls of the tubular spindle 8.

Each end of the cable 11 is connected to a tensioning mechanism 12 mounted within tubular spindles 8 and 10. The tensioning mechanism comprises a block 12*a* slidably mounted in the spindle 8. The end of the cable 11 is connected to one end of the block 12*a* as at 12*b*, and a vertically extending threaded stem 12*c* is fixedly connected by a lock nut 12*d* to the opposite end of the block 12*a*. The stem 12*c* is threadably received within a vertically extending tubular bolt 12*e* extending downwardly from the top rail 6. By this construction and arrangement, when the tubular bolt 12*e* is turned in one direction, the threaded stem 12*c* is drawn upwardly into the tubular bolt 12*e* to increase the tension on the cable 11, and when the tubular bolt 12*e* is turned in the opposite direction, the threaded stem 12*c* is moved outwardly from the tubular bolt 12*e* to decrease the tension on the cable 11.

Figure 5:
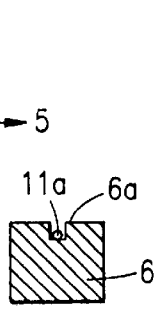
FIG. 5 is a view taken along line 5—5 of FIG. 3.
Figure 6:
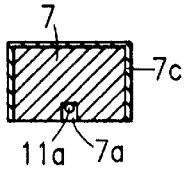
FIG. 6 is a view taken along line 6—6 of FIG. 3.

To complete the construction of the tensioned cable railing of the present invention, and to further enhance the appearance thereof, the exterior surfaces of the top and side walls of the top and bottom rails 6 and 7 are covered by longitudinally extending stainless steel channels providing caps 6*c* and 7*c*, respectively, as shown in FIGS. 5 and 6.

Figure 7:
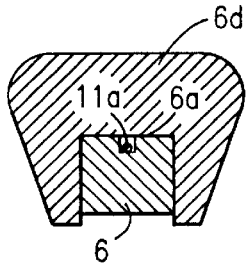
FIG. 7 is a sectional end view illustrating another embodiment of the top rail cover or cap.

FIG. 7 illustrates an alternative cap 6*d* for the top rail 6, and comprises a cross-sectionally configured longitudinally extending wooden strip which can be secured to the top rail 6 by suitable fasteners.

From the above description, it will be appreciated by those skilled in the art that the cable railing is an improvement over prior cable railings in that the tension of the cable 11 can be adjusted to enhance the safety of the railing, and by providing the longitudinally extending grooves 6*a* and 7*a* in the top and bottom rails 6 and 7 through which the bight portions 11*a* of the cable extend, the appearance of the railing 1 is improved.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

I claim:

1. A tensioned cable railing comprising a pair of horizontally spaced, vertically extending posts, a pair of horizontally extending, vertically spaced rails, the opposite ends of each rail being connected to a respective post to thereby provide top and bottom rails for the railing, a plurality of horizontally spaced, vertically extending tubular spindles extending between and connected to the top and bottom rails, a continuous cable extending in a serpentine manner between the top and bottom rails, a longitudinally extending continuous groove provided in the top rail and the bottom rail, said cable having bight portions positioned in said grooves, each end of said cable being connected to a respective spindle, and means operatively connected between each end of said cable and a respective spindle for tensioning said cable.

2. A tensioned cable railing according to claim 1, wherein caps are mounted on the top and bottom rails to cover the exterior surfaces thereof.

3. A tensioned cable railing according to claim 2, wherein the caps comprise longitudinally extending channels.

4. A tensioned cable railing according to claim 3, wherein the channels are stainless steel.

5. A tensioned cable railing according to claim 2, wherein the cap on the top rail comprises a cross-sectionally configured, longitudinally extending wooden strip.

6. A tensioned cable railing comprising a pair of horizontally spaced, vertically extending posts, a pair of horizontally extending, vertically spaced rails, the opposite ends of each rail being connected to a respective post to thereby provide top and bottom rails for the railing, a plurality of horizontally spaced, vertically extending tubular spindles extending between and connected to the top and bottom rails, at least one of the tubular spindles being a rigid spacer tube for maintaining the upper and lower rails in vertically spaced relationship, a cable extending in a serpentine manner between the top and bottom rails, each end of the cable being connected to a respective spindle, the portion of the cable intermediate the ends thereof extending through said rigid spacer tube, and means operatively connected between each end of said cable and a respective spindle for tensioning said cable.

7. A tensioned cable railing comprising a pair of horizontally spaced, vertically extending posts, a pair of horizontally extending, vertically spaced rails, the opposite ends of each rail being connected to a respective post to thereby provide top and bottom rails for the railing, a plurality of horizontally spaced, vertically extending tubular spindles extending between and connected to the top and bottom rails, a cable extending in a serpentine manner between top and bottom rails, each end of said cable being connected to a respective spindle, and tension means operatively connected between each end of said cable and a respective spindle for tensioning said cable; said tension means comprising a block slidably mounted in the spindle, and end of the cable being connected to said block, a threaded stem being fixedly connected to said block, a tubular bolt depending from said top rail, said stem being threadably received in said tubular bolt, whereby then the tubular bolt is turned in one direction, the threaded stem is drawn into the tubular bolt to increase the tension on the cable, and when the tubular bolt is turned in the opposite direction, the threaded stem is moved outwardly from the tubular bolt to decrease the tension on the cable.

* * * * *